US005266919A

United States Patent [19]

Cook et al.

[11] Patent Number: 5,266,919

[45] Date of Patent: Nov. 30, 1993

[54] TONE GENERATOR FOR USE WITH HEARING AIDS

[76] Inventors: Perry R. Cook, 2240 Hanover, Palo Alto, Calif. 94306; Leo Boyd, 945 Torero Plz., Campbell, Calif. 95008

[21] Appl. No.: 678,044

[22] Filed: Apr. 1, 1991

[51] Int. Cl.[5] ..... G08B 3/00

[52] U.S. Cl. ..... 340/384 E; 340/384 R; 381/68.2

[58] Field of Search ..... 340/384 E, 384 R; 381/68, 68.2, 68.4

[56] References Cited

U.S. PATENT DOCUMENTS

| | | | |
|---|---|---|---|
| 3,763,488 | 10/1973 | Klasing | 340/384 E |
| 3,981,007 | 9/1976 | Cieslak et al. | 340/384 R |
| 4,054,869 | 10/1977 | Smith et al. | 340/384 R |
| 4,471,171 | 9/1984 | Köpke et al. | 381/68 |

*Primary Examiner*—Donnie L. Crosland
*Attorney, Agent, or Firm*—Nathan N. Kallman

[57] ABSTRACT

A programmable tone generator provides a signal that can be used by a hearing aid wearer to set the gain of the hearing aid such that the hearing threshold is at a prescribed corrected level.

12 Claims, 2 Drawing Sheets

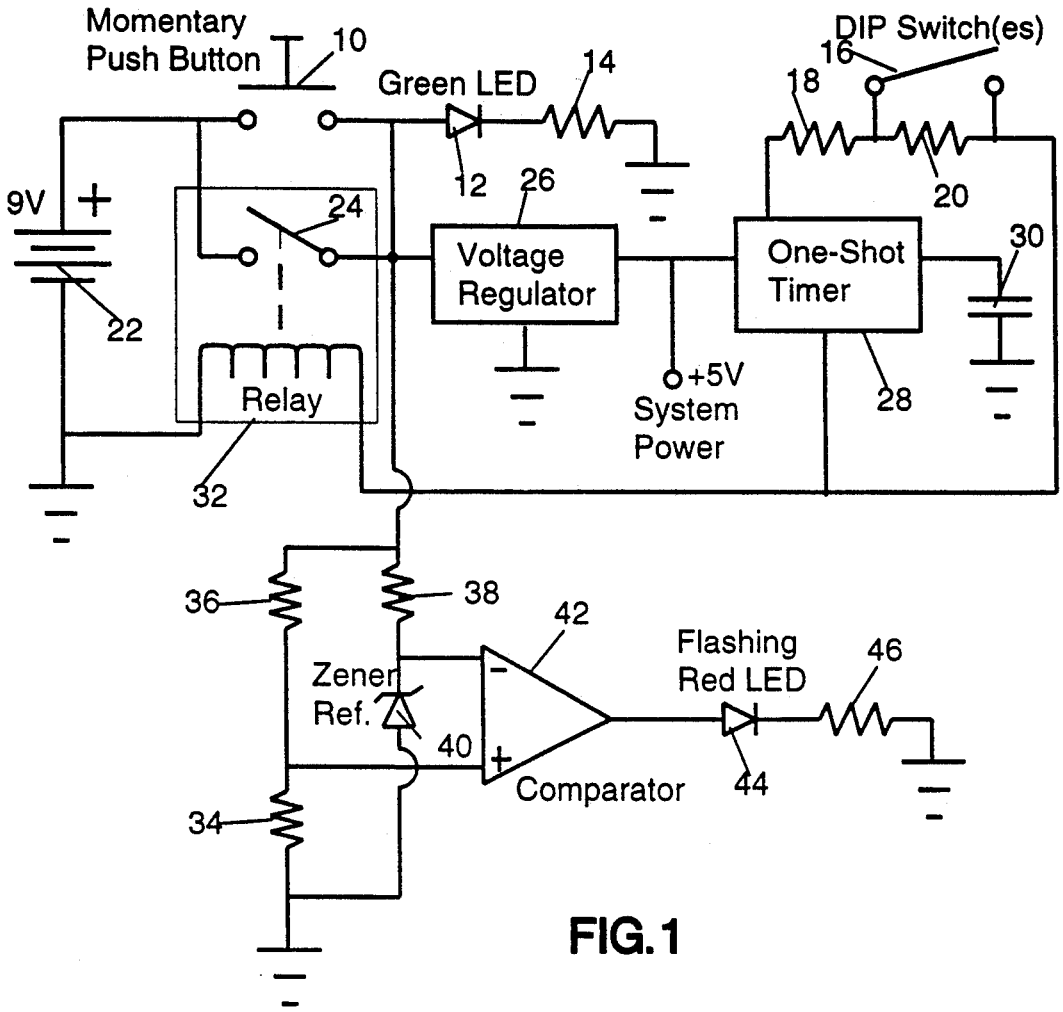
FIG. 1
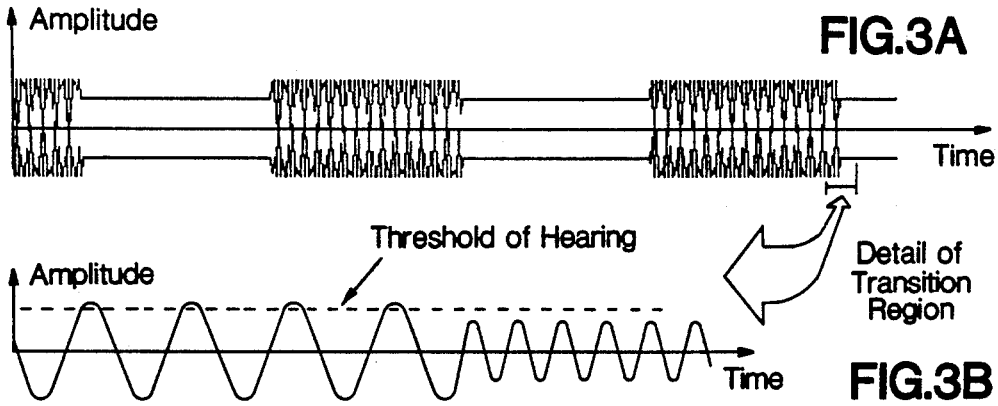
FIG.3A
FIG.3B

TONE GENERATOR FOR USE WITH HEARING AIDS

FIELD OF THE INVENTION

The invention relates to tone generators and in particular to a programmable calibrated tone generator that is useful with hearing aids.

BACKGROUND OF THE INVENTION

Hearing aids are typically built with an external rotary control knob that enables the wearer of a hearing aid to adjust the amplification of the aid and thus the level of sound presented to the ear of the wearer. This adjusting capability allows the wearer to compensate for change in the performance of the aid or the momentary preference of the wearer. A readjustment is generally required upon installation of a hearing aid, or after any inadvertent displacement of the control knob, or when using a telephone, or after reduction of amplification effectuated during a rest period.

With present day techniques, the wearer lacks a reliable acoustic standard or reference to which amplification of the hearing aid can be adjusted. Further, no calibrated source is available which indicates both over-amplification as well as under-amplification. Commonly used acoustic quasi-type standards or references are radio and television sets, for example. In a social gathering, the voices of members of the group may be used as a reference. Such sounds do not provide a reliable calibrated acoustic reference for an individual hearing aid wearer nor a reference with parameters specific to the user.

Audiometers are used by trained technicians at a business location to determine the parameters of the hearing aids that are required to compensate for hearing impairment. The data obtained by an audiometer is the threshold of detection of the hearer at selected frequencies throughout the audio frequency spectrum. They cannot be used for a sound intensity standard by an untrained hearing aid wearer.

Advances in microelectronics have led to advances in audiometer systems and in digital automated systems which may be used with audiometers. Examples of such audiometer systems are described in U.S. Pat. Nos. 4,471,171-Kopke et al; 4,489,610-Slavin et al; and 4,548,082-Engbretson et al.

Audiometer systems have been used to obtain appropriate parameter settings, including audio gain of hearing aids. However, these prior art systems require operation by a trained technician and are expensive to make and maintain. Furthermore, use of an audiometer system is restricted to the place of business of the technician. Audiometers so used have controlled variable outputs which permit the technician to determine hearing aid parameters for a broad spectrum of hearing impairments. The device described herein has output parameters set by the audiologist to provide a volume control standard for a given individual.

SUMMARY OF THE INVENTION

An object of this invention is to provide an audio reference means that allows the wearer of a hearing aid to adjust the hearing aid's gain to a prescribed range appropriate for the wearer.

Another object of the invention is to provide an audio signal whose perceived character is unique to each of the states of amplification, i.e., over, under and within the prescribed range.

Another object is to provide an audio reference means that can be adapted to be easily carried on the person and available for use at any time.

A further object is to provide a personal audio reference means that is inexpensive and easy to maintain.

According to this invention, a programmable calibrated tone generator comprises a power control circuit that acts as a constant power source for a digitally controlled analog oscillator/amplifier. The power control circuit includes a timing control circuit that serves to provide power to a voltage regulator. The timing circuit keeps a power relay activated for a predetermined amount of time. A low voltage sensor/indicator indicates when the voltage from a power supply, preferably a battery, has dropped below an acceptable level. The oscillator/amplifier circuit, which receives a constant steady voltage from the power control circuit, includes a toggle control clock circuit having a clock whose frequency is controlled by DIP programming switches. The clock controls the state of analog switches, which in turn control the frequency of the oscillator and the amplitude of the amplifier. The programmable oscillator produces a sinusoidal tone of stable frequency and stable amplitude specific to the state of the control clock pulse. The gain of the amplifier is also determined by the state of the control clock pulse. A loudspeaker converts the electrical output of the amplifier to an acoustical output from the tone generator which provides the user with a reference for adjusting a hearing aid.

BRIEF DESCRIPTION OF THE DRAWINGS

The invention will be described in greater detail with reference to the drawings in which; FIG. 1 is a schematic and block diagram of a power control circuit, used with the tone generator of this invention; FIG. 3A is a waveform showing the output reference signal derived from the inventive tone generator; and FIG. 3B is an enlarged representation of a detailed portion of the waveform of FIG. 3A showing the tone pattern and amplitudes as set by the audiologist relative to the prescribed hearing threshold of the wearer.

DETAILED DESCRIPTION OF THE PREFERRED EMBODIMENT

Figure 2:
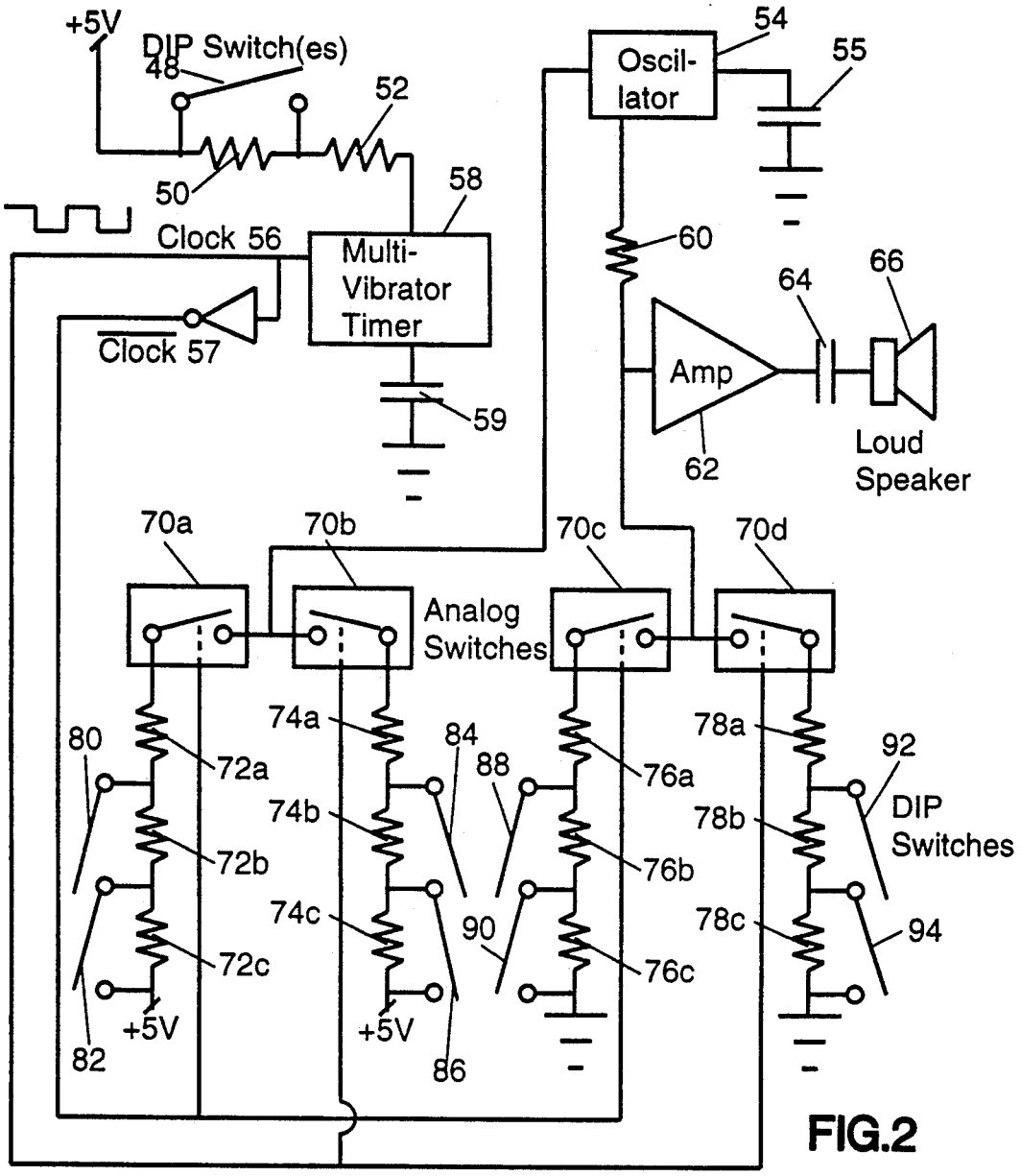
FIG. 2 is a schematic and block diagram of an analog oscillator-/amplifier circuit, as used with this invention.

As shown in FIG. 1, a power supply circuit used with the tone generator of this invention includes a momentary push button 10, which can be actuated manually by a user, who may be the wearer of a hearing aid by way of example. When push button 10 is depressed, the control circuit is actuated by power from a 9 volt battery 22. Battery power is directed through closed relay contact 24 to a voltage regulator 26 that provides a constant power source, such as +5 volt DC, to all active components of the tone generator system. A light emitting diode (LED) 12, preferably emitting green light, is energized to indicate an operating state of the tone generator device. A limiting resistor 14 is located between the LED 12 and ground or reference potential.

Power from the battery supply 22 is passed through momentary pushbutton 10 and the contact 24 of relay 32. Depressing the momentary pushbutton 10 causes supply voltage to be applied to voltage regulator 26. The regulator provides voltage to the one-shot timer 28.

The one-shot timer 28 supplies voltage to the coil of relay 32 for a time which is predetermined by the timing capacitor 30, the resistors 18 and 20, and the DIP programming switch 16. In accordance with this invention, the DIP switches 16 are effectively programmable so that the amount of resistance which is used to charge the timing capacitor 30 of the timing circuit can be selected to determine the power-on time of the tone generator after activation. After the one-shot timer 28 has completed its timing cycle, power is removed from the coil of relay 32, and all power is removed from the system by the deactivation of the contact 24 of relay 32.

The circuit consisting of resistor 38 and Zener reference diode 40 provides a constant reference voltage to the comparator 42 when the system is on. The comparison input of the comparator 42 is provided a voltage which is linearly related to the battery supply voltage, as determined by the resistor divider comprised of resistors 36 and 34. If the comparison voltage provided by resistors 36 and 34 is less than the reference voltage provided by resistor 38 and Zener reference diode 40, the comparator 42 provides a high signal which activates LED 44. LED 44 indicates by a flashing red light that the battery voltage is below an acceptable level. A limiting resistor 46 is connected between the LED 44 and ground.

In operation, the power control circuit provides a constant voltage source to the oscillator/amplifier of FIG. 2. A steady +5 volts is applied to the DIP switch assembly 48, which is connected across resistor 50. Resistor 52 is connected in series with resistor 50 and to the DIP switch assembly 48. The programmable DIP switch assembly, which allows selection of resistance values by selection of combinations of resistances 50 and 52, control a toggle control clock circuit comprising a multivibrator timer 58, a capacitor 59 and inverter 57. The frequency of the clock signal is determined by the charging resistance selected by the programmable DIP switches 48 and the resultant charging rate of the timing capacitor 59. The toggle control circuit provides a 50% duty cycle clock signal and its complement through inverter 57 for controlling the state of analog switches.

Analog switches 70*a*, 70*b*, 70*c*, 70*d* control the operation of programmable oscillator 54 and programmable amplifier 62. The analog switches 70*a* and 70*c* are connected respectively to two networks of resistors 72*a–c* and 76*a–c*, whereas switches 70*b* and 70*d* are connected respectively to two networks of series-connected resistors 74*a–c* and 78*a–c*. Sets of DIP programming switches 80–82, 84–86, 88–90, 92–94 are connected across the resistors of the networks to vary the resistive value of each network 72,74, 76, 78 of associated resistors.

To set the values of the resistances and thus the parameters of the acoustic output signal of the tone generator for each state of the clocking pulse, one of two sets of networks of resistors, either 72*a–c* and 76*a–c*, or 74*a–c* and 78*a–c*, is selected by closing the associated analog switches 70*a* and 70*c* or 70*b* and 70*d*. The first selection is made when the output state of the toggle control clock circuit is high. The resistors that are selected and applied to the circuit operation are determined by the positions of the DIP programming switches 80–94. The selected combination of resistors are connected to the control inputs of the programmable oscillator 54 and the programmable amplifier 62. A second selection is made by the clock complement output of inverter 57 when the output state of the toggle control circuit is low.

For each selection, the programmable oscillator 54 produces a respective sinusoidal tone of stable frequency that is effectively determined by the values of the timing capacitor 55 and the control resistors 72*a–c* or 74*a–c* connected to the oscillator 54 by means of the analog switches 70*a* and 70*b*. The programmable amplifier 62 amplifies the output of the oscillator 54 by an amount determined by the values of resistor 60 and the control resistors 76*a–c* or 78*a–c* connected to the amplifier by switches 70*c* and 70*d*. The amplifier 62 provides an output through a coupling capacitor 64 to drive a loudspeaker 66 which converts the electrical output of the amplifier to produce an audio sound.

To program the tone generator, the DIP switches 80–94 are set so that the tone generator produces two tones of the same or different frequencies having amplitudes just above and below the prescribed corrected threshold of hearing of an individual wearing a hearing aid, as depicted in FIG. 3B. An enlarged detail of the transition region of FIG. 3A is shown in FIG. 3B which shows the relation of the amplitudes of the two tones to the prescribed corrected threshold of hearing. The frequencies and amplitudes of the tones are chosen by an audiologist to provide a suitable standard for the unique hearing loss pattern of an individual.

An advantage of the tone generator of this invention is that the hearing aid wearer can operate the tone generator himself at his own convenience without further need for an audiologist. To accomplish the setting of the volume control of the hearing aid, the user locates the tone generator at arms length in a quiet room, covers the ear that is not being calibrated, and depresses the push button 10 momentarily to activate. If both tones are heard, the hearing aid volume is too loud. If no tones are heard, the hearing aid volume is too low. The hearing aid volume is properly adjusted until when only one tone is heard.

By locating the tone generator at arms length and adjusting the hearing aid until only a single tone is heard from the generator by the ear being calibrated, the user is assured of an appropriate adjustment of the hearing aid gain. The tone generator uses semiconductor chip technology and is relatively inexpensive and easy to maintain. Since the generator is compact, light and portable, it may be carried and used by the hearing aid wearer.

An obvious variation in design would utilize more clock states, analog switch pairs like 70*a* and 70*c* and resistor networks. Such a device would provide a larger number of discrete tones, each having selectable frequency and amplitude for applications requiring more than two calibrated tone standards.

What is claimed is:

1. A programmable calibrated tone generator for generating a reference tone signal comprising:

a power supply circuit for providing a source of constant steady voltage;

a digitally controlled analog circuit coupled to said power supply circuit for generating two electrical signals to produce acoustic tones, each having a selectable amplitude, frequency and duration, wherein said analog circuit includes a plurality of resistive networks having selectable resistance values;

switch means for selecting resistance values of said resistive networks to vary the amplitude, frequency and duration of said generated electrical signals.

2. A tone generator as in claim 1, wherein said switch means comprises a multiplicity of clock pulse controlled analog switches; and an oscillator coupled to certain ones of said analog switches for producing an electrical signal of selected frequency.

3. A tone generator as in claim 2, including an amplifier coupled to said oscillator for providing an amplified signal; and a loudspeaker coupled to said amplifier for providing an audio signal corresponding to said electrical signal.

4. A tone generator as in claim 2, wherein each of said analog switches is coupled to a respective one of said resistive networks, each one of said resistive networks having a plurality of series-connected resistors; programmable DIP switches coupled to said resistors for determining the resistance of each one of said resistive networks.

5. A tone generator as in claim 4, including a toggle clock control circuit coupled to said analog switches for controlling the state of said analog switches.

6. A tone generator as in claim 5, including programmable DIP switches connected to said power control circuit for providing a clock cycle having high and low states of equal duration.

7. A tone generator as in claim 6, wherein said clock control circuit comprises a multivibrator time circuit; and a timing capacitor connected to said multivibrator timer circuit.

8. A tone generator as in claim 7, including a voltage regulator for providing a constant power source, a one-shot timer coupled to said regulator, a relay connected to said timer and a momentary push button for actuating said power control circuit.

9. A tone generator as in claim 1, wherein said power control circuit includes a voltage regulator for maintaining a constant voltage output as a power source for said tone generator.

10. A tone generator as in claim 1, including means for indicating the operating state of said tone generator; and means for providing an indication of the status of said power supply circuit.

11. A tone generator as in claim 10, wherein said power supply status indicating means comprises a Zener diode for providing a reference signal and a comparator coupled to said power supply circuit.

12. A pocket size tone generator for providing tones of selected amplitude and frequency comprising:

an oscillator for producing an electrical signal of selected frequency;

an amplifier coupled to said oscillator for providing an amplified signal of said electrical signal;

a power supply circuit for supplying a steady voltage;

alternately selectable resistor means coupled to said oscillator and said amplifier for controlling the amplitude and frequency of said tones;

analog switching means, including a first switch means and a second switch means, coupled between said selectable resistor means and said oscillator and amplifier for controlling the amplitude and frequency of said electrical signal;

a clock signal generator having a selectable cycle time for producing a pulse signal having two alternate pulse states to control said switching means for alternately connecting said resistor means to said oscillator and said amplifier;

switch means for setting resistor values to select the cycle time of said pulse signal and to determine the amplitude and frequency of said electrical signal during each state of said pulse signal so that the amplitude during one pulse state is higher than the amplitude during the alternate pulse state and the frequency during one pulse state is greater than the frequency during the alternate pulse state.

* * * * *